US005682765A

United States Patent [19]

Lynch et al.

[11] Patent Number: 5,682,765

[45] Date of Patent: Nov. 4, 1997

[54] CRYOGENIC RECTIFICATION SYSTEM FOR PRODUCING ARGON AND LOWER PURITY OXYGEN

[75] Inventors: Nancy Jean Lynch, North Tonawanda; Dante Patrick Bonaquist, Grand Island, both of N.Y.

[73] Assignee: Praxair Technology, Inc., Danbury, Conn.

[21] Appl. No.: 764,430

[22] Filed: Dec. 12, 1996

[51] Int. Cl.[6] ..... F25J 3/02

[52] U.S. Cl. ..... 62/646; 62/924

[58] Field of Search ..... 62/646, 924

[56] References Cited

U.S. PATENT DOCUMENTS

| | | | |
|---|---|---|---|
| 5,305,611 | 4/1994 | Howard | 62/22 |
| 5,315,833 | 5/1994 | Ha et al. | 62/38 |
| 5,349,824 | 9/1994 | Ha et al. | 62/24 |
| 5,396,773 | 3/1995 | Ha et al. | 62/39 |
| 5,426,946 | 6/1995 | Corduan et al. | 62/924 |
| 5,440,884 | 8/1995 | Bonaquist et al. | 62/22 |
| 5,469,710 | 11/1995 | Howard et al. | 62/22 |
| 5,490,391 | 2/1996 | Hogg et al. | 62/924 |
| 5,528,906 | 6/1996 | Naumovitz et al. | 62/652 |
| 5,533,339 | 7/1996 | Clare et al. | 62/654 |

*Primary Examiner*—Ronald C. Capossela
*Attorney, Agent, or Firm*—Stanley Ktorides

[57] ABSTRACT

A cryogenic rectification system wherein additional stripping vapor for the lower pressure column of a double column is produced from higher pressure column bottoms and feed for the argon column is taken from the upper portion of the lower pressure column and first processed through a stripping column. Lower purity oxygen is recovered either directly from the lower pressure column or after first being processed in an auxiliary column which additionally produces higher purity oxygen.

10 Claims, 2 Drawing Sheets

CRYOGENIC RECTIFICATION SYSTEM FOR PRODUCING ARGON AND LOWER PURITY OXYGEN

TECHNICAL FIELD

This invention relates generally to the cryogenic rectification of feed air and, more particularly, to the cryogenic rectification of feed air to produce lower purity oxygen.

BACKGROUND ART

The demand for lower purity oxygen is increasing in applications such as glassmaking, steelmaking and energy production. Lower purity oxygen is generally produced in large quantities by the cryogenic rectification of feed air in a double column wherein feed air at the pressure of the higher pressure column is used to reboil the liquid bottoms of the lower pressure column and is then passed into the higher pressure column. Some users of lower purity oxygen, for example integrated steel mills, often require some higher purity oxygen in addition to lower purity gaseous oxygen.

In some situations it is desirable to produce argon in addition to lower purity oxygen. However, with conventional systems there can be achieved only a very low argon recovery because, due to the relative volatilities of the major components of air, most of the argon in the feed air, as much as 80 percent of this incoming argon, exits the system with the product lower purity oxygen.

Accordingly it is an object of this invention to provide a system for effectively producing both lower purity oxygen product and argon product by the cryogenic rectification of feed air.

SUMMARY OF THE INVENTION

The above and other objects, which will become apparent to one skilled in the art upon a reading of this disclosure, are attained by the present invention, one aspect of which is:

A method for producing argon and lower purity oxygen by the cryogenic rectification of feed air comprising:

(A) passing feed air into a higher pressure column of a double column which also comprises a lower pressure column and producing oxygen-enriched liquid by cryogenic rectification within the higher pressure column;

(B) withdrawing oxygen-enriched liquid from the higher pressure column, at least partially vaporizing the withdrawn oxygen-enriched liquid to produce oxygen-enriched vapor, and passing the oxygen-enriched vapor into the lower portion of the lower pressure column;

(C) producing lower purity oxygen fluid within the lower pressure column, withdrawing a fluid comprising argon and nitrogen from the upper portion of the lower pressure column and passing said fluid into a stripping column;

(D) producing argon-enriched fluid in the stripping column and passing argon-enriched fluid from the stripping column into an argon column;

(E) producing argon-richer fluid within the argon column and recovering argon-richer fluid as product argon; and (F) recovering lower purity oxygen fluid as product lower purity oxygen.

Another aspect of the invention is:

Apparatus for producing argon and lower purity oxygen by the cryogenic rectification of feed air comprising:

(A) a double column comprising a first column and a second column and means for passing feed air into the first column;

(B) a stripping vapor heat exchanger, means for passing fluid from the lower portion of the first column into the stripping vapor heat exchanger, and means for passing fluid from the stripping vapor heat exchanger into the lower portion of the second column;

(C) a stripping column and means for passing fluid from the upper portion of the second column into the stripping column;

(D) an argon column and means for passing fluid from the lower portion of the stripping column into the argon column;

(E) means for withdrawing fluid from the upper portion of the argon column for recovery as product argon; and (F) means for withdrawing fluid from the lower portion of the second column for recovery as product lower purity oxygen.

As used herein, the term "feed air" means a mixture comprising primarily oxygen, nitrogen and argon, such as ambient air.

As used herein, the term "column" means a distillation or fractionation column or zone, i.e. a contacting column or zone, wherein liquid and vapor phases are counter currently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process*. The term, double column, is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein, the term "reboiler" means a heat exchange device that generates column upflow vapor from column liquid. A reboiler may be located within or outside of the column.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the mid point of the column.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein, the term "lower purity oxygen" means a fluid having an oxygen concentration with the range of from 50 to less than 98 mole percent.

As used herein, the term "higher purity oxygen" means a fluid having an oxygen concentration equal to or greater than 98 mole percent.

As used herein, the term "argon column" means a column which processes a feed comprising argon and produces a product having an argon concentration which exceeds that of the feed.

As used herein, the term "stripping column" means a column wherein liquid is introduced into the upper portion of the column and more volatile component(s) are removed or stripped from descending liquid by rising vapor.

DETAILED DESCRIPTION

In general the invention comprises the providing of additional stripping vapor into the lower pressure column in the lower portion of the column. The additional stripping vapor originates from the lower portion of the higher pressure column and has a lower argon concentration relative to the stripping vapor generated by the lower pressure column bottom reboiler in a conventional double column system used to produce lower purity oxygen. The additional stripping vapor rises within the lower pressure column, and argon within this column preferentially passes into this rising vapor rather than passing down the column with the descending liquid and out of the column with the lower purity oxygen fluid. The resulting fluid, which contains a substantial amount of nitrogen in addition to the argon, is further processed in a stripping column for nitrogen removal and the resulting argon-richer fluid is processed in an argon column to produce argon product.

Figure 1:
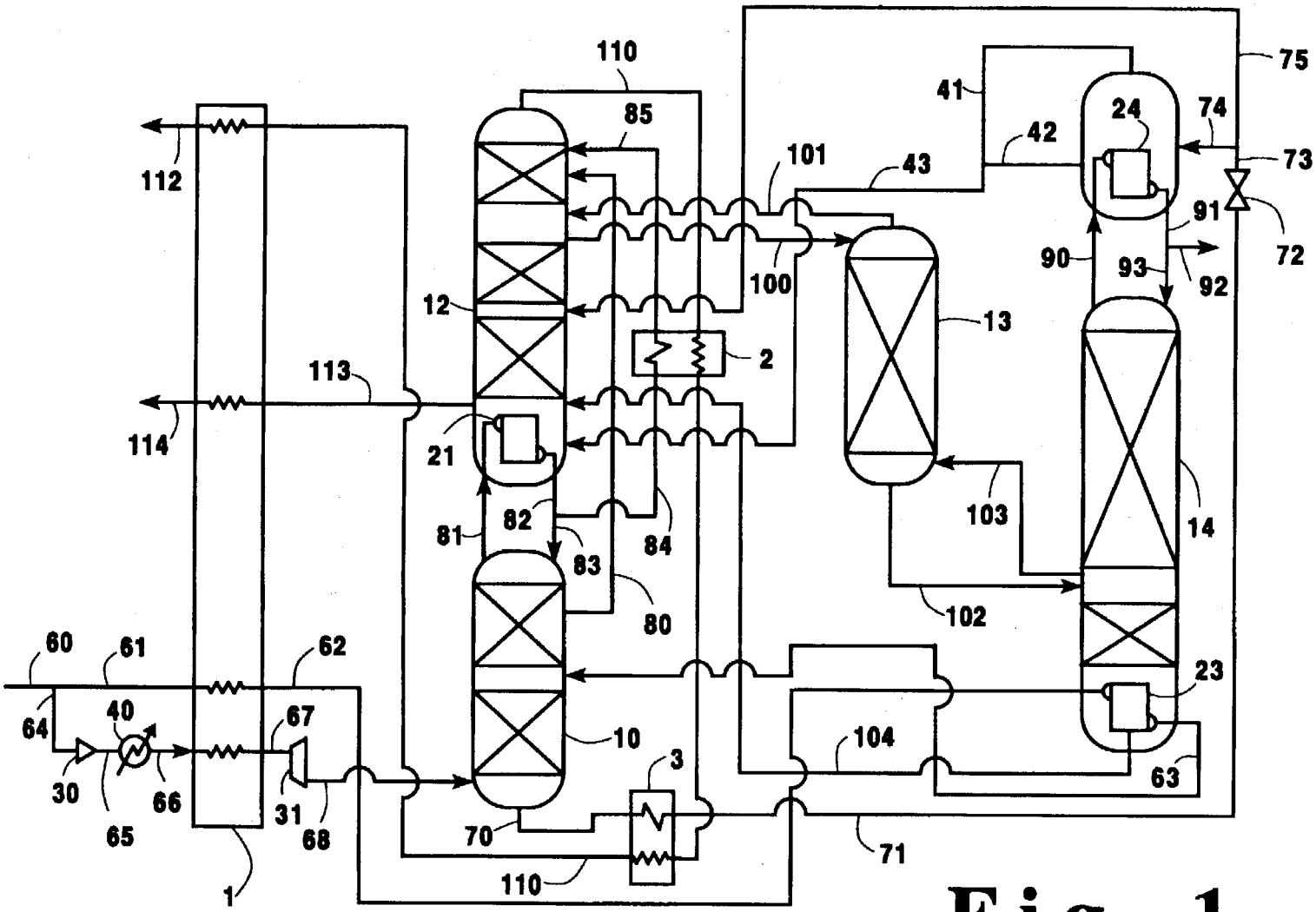
FIG. 1 is a schematic representation of one preferred embodiment of the invention wherein lower purity oxygen is recovered from the lower pressure column.

The invention will be described in detail with reference to the Drawings. Referring now to FIG. 1, feed air 60, which has been cleaned of high boiling impurities such as carbon dioxide, water vapor and hydrocarbons and which has been compressed to a pressure generally within the range of from 65 to 75 pounds per square inch absolute (psia), is divided into first portion 61, comprising from about 20 to 30 percent of the feed air, and into second portion 64 comprising from about 70 to 80 percent of the feed air. First feed air portion 61 is cooled by indirect heat exchange with return streams in main heat exchanger 1. Resulting cooled first feed air portion 62 is at least partially condensed in bottom reboiler 23 by indirect heat exchange with boiling argon column 14 bottom liquid, and resulting fluid 62 is passed into first or higher pressure column 10 which is the higher pressure column of a double column which also comprises second or lower pressure column 12. Second feed air portion 64 is compressed to a pressure generally within the range of from 85 to 95 psia by passage through compressor 30, resulting compressed stream 65 is cooled of heat of compression by passage through cooler 40, and resulting stream 66 is cooled by indirect heat exchange with return streams in main heat exchanger 1. Resulting cooled feed air 67 is turboexpanded through turboexpander 31 to generate refrigeration and resulting feed air stream 68, at about the operating pressure of the higher pressure column 10 is passed into higher pressure column 10.

Within higher pressure column 10 the feeds into the column are separated by cryogenic rectification into nitrogen-enriched vapor and oxygen-enriched liquid. Nitrogen-enriched vapor is passed in stream 81 from the upper portion of higher pressure column 10 into bottom reboiler 21 of lower pressure column 12 wherein it is condensed by indirect heat exchange with boiling lower pressure column 12 bottom liquid. Resulting nitrogen-enriched liquid 82 is divided into first portion 83 which is passed into the upper portion of higher pressure column 10 as reflux, and into second portion 84 which is subcooled by passage through subcooler 2 and passed as stream 85 into the upper portion of lower pressure column 12 as reflux. An additional nitrogen-enriched fluid stream 80 is passed from the upper portion of higher pressure column 10 into the upper portion of lower pressure column 12 as additional feed into lower pressure column 12.

Oxygen-enriched liquid comprises generally from 35 to 45 mole percent oxygen and less than about 2 mole percent argon, with nitrogen comprising substantially all of the remainder. Oxygen-enriched liquid is withdrawn from the lower portion of higher pressure column 10 in stream 70 and subcooled by passage through subcooler 3. Resulting stream 71 is reduced in pressure by passage through valve 72 and resulting stream 73 is divided into first portion 74 and into second portion 75 which is passed into lower pressure column 12 as feed for the column. First oxygen-enriched liquid portion 74 is passed into argon column top condenser 24 which in this embodiment of the invention serves as the stripping vapor heat exchanger of the invention. Within top condenser 24 the oxygen-enriched liquid is vaporized by indirect heat exchange with argon column top vapor and resulting oxygen-enriched vapor 41, preferably along with any remaining unvaporized oxygen-enriched liquid 42, is passed in stream 43 into the lower portion of lower pressure column 12, preferably, as illustrated in FIG. 1, at the level of bottom reboiler 21.

The oxygen-enriched vapor provided into lower pressure column 12 in stream 43 provides additional upflowing vapor or stripping vapor into the column in addition to that generated by bottom reboiler 21. This additional stripping vapor has a lower argon concentration than the vapor generated by the bottom reboiler of a conventional lower purity oxygen process and thus serves to preferentially strip argon out of the downflowing liquid within the column. The introduction of the oxygen-enriched vapor, which contains a significant amount of nitrogen, at this lower point in the lower pressure column provides the additional benefit of decreasing the boiling temperature in the bottom reboiler which reduces the overall energy requirements for the system.

In the practice of this invention the feed for the argon column is taken from the upper portion of the lower pressure column rather than from the lower portion as in conventional practice. This stream is illustrated as stream 100 in FIG. 1. Referring back now to FIG. 1, a fluid comprising from about 8 to 20 mole percent argon, from about 60 to 82 mole percent nitrogen, with the remainder comprised substantially of oxygen, is withdrawn from the upper portion of lower pressure column 12 in stream 100 at a level generally from 15 to 40, preferably 15 to 25, equilibrium stages above the level at which additional stripping vapor in stream 43 is passed into the column. Stream 100 is passed into stripping column 13 wherein it undergoes cryogenic rectification to produce argon-enriched fluid and nitrogen top vapor. The nitrogen top vapor is passed in stream 101 from the upper portion of stripping column 13 into the upper portion of lower pressure column 12. Argon-enriched fluid, which has an argon concentration which exceeds that of the argon-containing fluid in stream 100, is passed from the lower portion of stripping column 13 into argon column 14 in stream 102. A vapor stream 103 is passed from argon column 14 into the lower portion of stripping column 13 to serve as upflowing vapor for the stripping column.

Within argon column 14 the argon-enriched fluid is separated by cryogenic rectification in argon-richer fluid and oxygen-richer fluid. Argon richer fluid, which has an argon concentration generally of at least 95 mole percent, is passed in vapor stream 90 into top condenser 24 wherein it is at least partially condensed by indirect heat exchange with the vaporizing oxygen-enriched liquid as was previously described. If desired, some of argon-richer stream 90 may be recovered as product argon either upstream or downstream of top condenser 24. In the embodiment of the invention illustrated in FIG. 1, all of stream 90 is passed into top condenser 24 wherein it is completely condensed. Argon-richer liquid 91 from top condenser 24 is passed in part 93 into the upper portion of argon column 14 as reflux and recovered in part 92 as product argon. Oxygen-richer fluid is passed in stream 104 from the lower portion of argon column 14 into lower pressure column 12.

Lower pressure column 12 is operating at a pressure less than that of higher pressure column 10 and generally within the range of from 18 to 22 psia. Within lower pressure column 12 the various feeds are separated by cryogenic rectification into nitrogen-richer fluid and lower purity oxygen fluid. Nitrogen-richer fluid is withdrawn from the upper portion of lower pressure column 12 in stream 110, warmed by passage through heat exchangers 2, 3 and 1 and removed from the system in stream 112 which may be recovered in whole or in part as product nitrogen having a nitrogen concentration of 98 mole percent or more.

Lower purity oxygen fluid is withdraw from the lower portion of lower pressure column 12 for recovery as product lower purity oxygen. In the embodiment of the invention illustrated in FIG. 1, the lower purity oxygen fluid withdrawn from lower pressure column 12 undergoes no further separation prior to recovery, i.e. it is recovered as product directly from the lower pressure column. Referring back to FIG. 1, lower purity oxygen fluid is withdrawn from the lower portion of lower pressure column 12 as vapor stream 113, warmed by passage through main heat exchanger 1 and recovered as product lower purity oxygen gas in stream 114. In addition, some of the lower purity oxygen fluid may be withdrawn from column 12 as liquid and recovered as product lower purity oxygen liquid. In still another alternative, the lower purity oxygen fluid may be withdrawn from the lower portion of the lower pressure column as liquid, some may be recovered as liquid product lower purity oxygen and some or all of the withdrawn liquid may be pumped to a higher pressure, vaporized and recovered as high pressure lower purity oxygen gas product.

Figure 2:
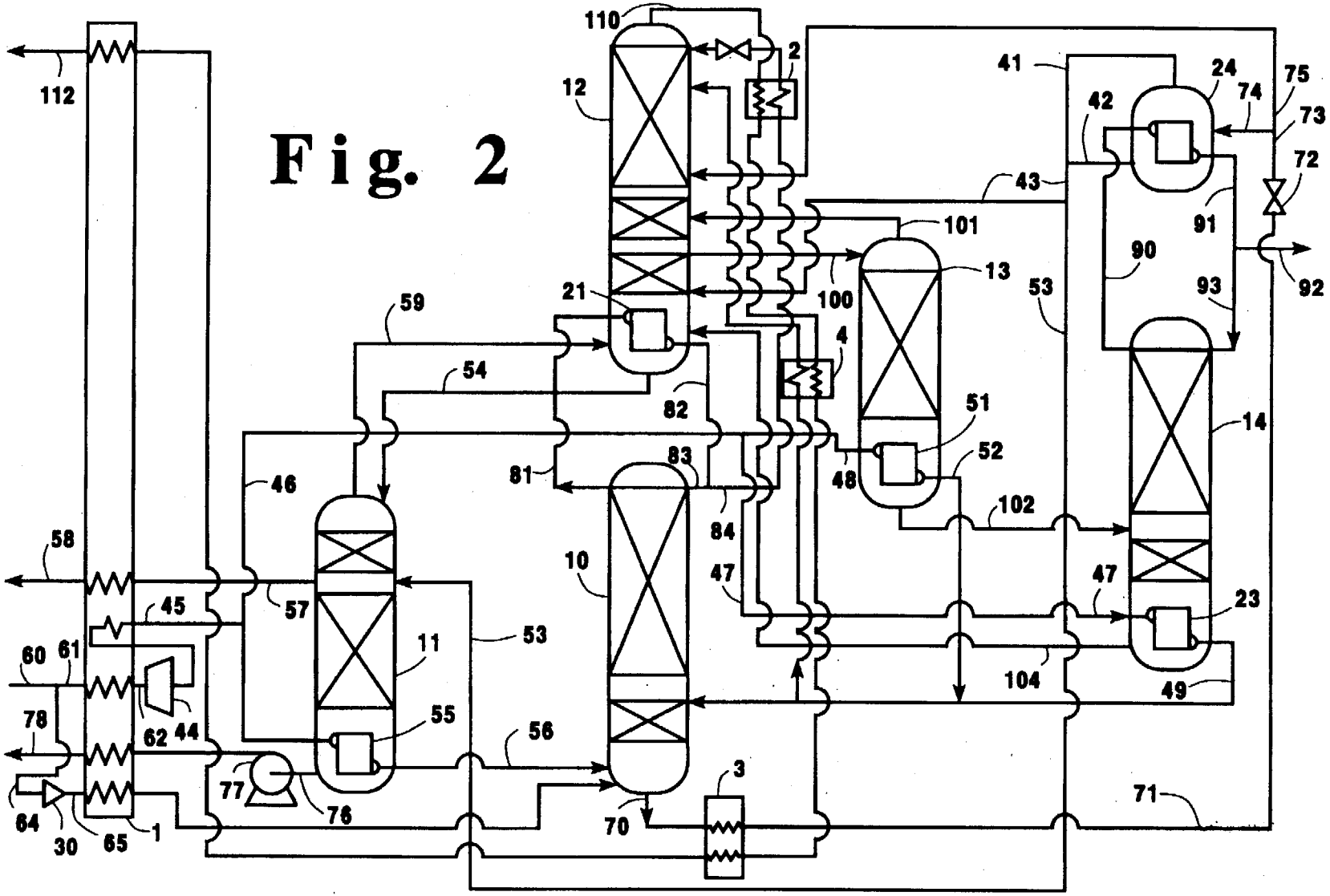
FIG. 2 is a schematic representation of another preferred embodiment of the invention wherein lower purity oxygen is withdrawn from the lower pressure column, passed into an auxiliary column and recovered from the auxiliary column, and wherein higher purity oxygen is also recovered from the auxiliary column.

In some situations it may be desirable to recover some higher purity oxygen in addition to argon and lower purity oxygen. In FIG. 2 there is illustrated one embodiment of the invention wherein higher purity oxygen is also produced. The numerals in FIG. 2 correspond to those of FIG. 1 for the common elements and these common elements will not be discussed again in detail.

The embodiment of the invention illustrated in FIG. 2 differs from that illustrated in FIG. 1 primarily by the inclusion of an auxiliary column which processes lower purity oxygen fluid taken from the lower pressure column to produce higher purity oxygen in addition to the lower purity oxygen. Referring now to FIG. 2, compressed feed air portion 65 is not turboexpanded but rather is passed directly into higher pressure column 10 after passage through main heat exchanger 1. Cooled feed air portion 62 is turboexpanded by passage through turboexpander 44 and turboexpanded feed air stream 45 is warmed by partial traverse of main heat exchanger 1 and divided into three portions 46, 47 and 48. Portion 47 reboils the bottom of argon column 14 in the same manner as stream 62 in the embodiment illustrated in FIG. 1. Resulting stream 49 is passed into higher pressure column 10. A portion 50 of stream 49 is subcooled by passage through subcooler 4 and then passed into the upper portion of lower pressure column 12. Feed air portion 48 is passed into bottom reboiler 51 of stripping column 13 wherein it is condensed to generate upflowing vapor for stripping column 13, thus removing the need to pass vapor from the argon column into the stripping column to serve as the upflowing vapor. Resulting condensed feed air portion 52 is passed into higher pressure column 10. Preferably, as illustrated in FIG. 2, stream 52 is combined with stream 49 and further processed as such. Nitrogen-richer vapor 110 is warmed by passage through heat exchanger 4 as well as heat exchangers 1, 2 and 3 prior to removal from the system. A portion 53 of oxygen-enriched vapor 43 is not passed into lower pressure column 12 but rather is passed into auxiliary column 11.

Lower purity oxygen fluid is withdrawn from the lower portion of lower pressure column 12 as liquid stream 54 and passed into the upper portion of auxiliary column 11 wherein it is separated by cryogenic rectification into higher purity oxygen and lower purity oxygen having a lower oxygen concentration than the lower purity oxygen stream in 54. Auxiliary column 11 is operating at a pressure generally within the range of from 18 to 22 psia and is driven by feed air portion 46 which is condensed in auxiliary column bottom reboiler 55 to produce upflowing vapor for auxiliary column 11. Resulting condensed feed air 56 is passed into higher pressure column 10 for separation.

Lower purity oxygen is withdrawn as stream 57 from the upper portion of auxiliary column 11, warmed by passage through main heat exchanger 1 and recovered as product lower purity oxygen 58. Top vapor, taken from above the level where stream 57 is withdrawn from auxiliary column 11, is passed as stream 59 from auxiliary column 11 into the lower portion of lower pressure column 12. Higher purity oxygen fluid is withdrawn as liquid stream 76 from the lower portion of auxiliary column 11 for recovery as product higher purity oxygen. If desired, stream 76 may be pumped to a higher pressure by passage through liquid pump 77, vaporized by passage through main heat exchanger 1, and recovered as product high pressure higher purity oxygen gas 78.

Now by the practice of this invention one can effectively produce both product argon and product lower purity oxygen by the cryogenic rectification of feed air and, if desired, one can additionally produce higher purity oxygen. Although the invention has been described in detail with reference to certain preferred embodiments, those skilled in the art will recognize that there are other embodiments of the invention within the spirit and the scope of the claims.

We claim:

1. A method for producing argon and lower purity oxygen by the cryogenic rectification of feed air comprising:

(A) passing feed air into a higher pressure column of a double column which also comprises a lower pressure column and producing oxygen-enriched liquid by cryogenic rectification within the higher pressure column;

(B) withdrawing oxygen-enriched liquid from the higher pressure column, at least partially vaporizing the withdrawn oxygen-enriched liquid to produce oxygen-enriched vapor, and passing the oxygen-enriched vapor into the lower portion of the lower pressure column;

(C) producing lower purity oxygen fluid within the lower pressure column, withdrawing a fluid comprising argon and nitrogen from the upper portion of the lower pressure column and passing said fluid into a stripping column;

(D) producing argon-enriched fluid in the stripping column and passing argon-enriched fluid from the stripping column into an argon column;

(E) producing argon-richer fluid within the argon column and recovering argon-richer fluid as product argon; and (F) recovering lower purity oxygen fluid as product lower purity oxygen.

2. The method of claim 1 wherein product lower purity oxygen is recovered directly from the lower pressure column.

3. The method of claim 1 wherein lower purity oxygen fluid is passed from the lower pressure column into an auxiliary column wherein it is separated into lower purity oxygen and higher purity oxygen, and wherein product lower purity oxygen is recovered from the auxiliary column and higher purity oxygen is recovered from the auxiliary column.

4. The method of claim 3 further comprising passing oxygen-enriched vapor into the auxiliary column.

5. The method of claim 1 wherein the fluid comprising argon and nitrogen withdrawn from the lower pressure column is withdrawn from 15 to 40 equilibrium stages above the level where oxygen-enriched vapor is passed into the lower pressure column.

6. Apparatus for producing argon and lower purity oxygen by the cryogenic rectification of feed air comprising:

(A) a double column comprising a first column and a second column and means for passing feed air into the first column;

(B) a stripping vapor heat exchanger, means for passing fluid from the lower portion of the first column into the stripping vapor heat exchanger, and means for passing fluid from the stripping vapor heat exchanger into the lower portion of the second column;

(C) a stripping column and means for passing fluid from the upper portion of the second column into the stripping column;

(D) an argon column and means for passing fluid from the lower portion of the stripping column into the argon column;

(E) means for withdrawing fluid from the upper portion of the argon column for recovery as product argon; and (F) means for withdrawing fluid from the lower portion of the second column for recovery as product lower purity oxygen.

7. The apparatus of claim 6 wherein the means for withdrawing fluid from the lower portion of the second column for recovery as product lower purity oxygen comprises an auxiliary column, means for passing fluid from the lower portion of the second column into the upper portion of the auxiliary column, and means for recovering fluid from the upper portion of the auxiliary column.

8. The apparatus of claim 7 further comprising means for recovering fluid from the lower portion of the auxiliary column.

9. The apparatus of claim 7 further comprising means for passing fluid from the stripping vapor heat exchanger into the auxiliary column.

10. The apparatus of claim 6 wherein the means for passing fluid from the upper portion of the second column into the stripping column communicates with the second column at a level from 15 to 40 equilibrium stages above the level where the means for passing fluid from the stripping vapor heat exchanger into the lower portion of the second column communicates with the second column.

* * * * *